US009107514B1

(12) United States Patent
Morieras

(10) Patent No.: US 9,107,514 B1
(45) Date of Patent: Aug. 18, 2015

(54) JEWELRY STAND

(71) Applicant: Desiree Morieras, Fischer, TX (US)

(72) Inventor: Desiree Morieras, Fischer, TX (US)

( * ) Notice: Subject to any disclaimer, the term of this patent is extended or adjusted under 35 U.S.C. 154(b) by 16 days.

(21) Appl. No.: 14/324,469

(22) Filed: Jul. 7, 2014

(51) Int. Cl.
*A47F 7/02* (2006.01)
*A47F 5/04* (2006.01)
*A47F 5/02* (2006.01)

(52) U.S. Cl.
CPC ... *A47F 7/02* (2013.01); *A47F 5/02* (2013.01); *A47F 5/04* (2013.01)

(58) Field of Classification Search
CPC ..... A47F 5/02; A47F 5/05; A47F 5/06; A47F 5/0087; A47F 5/01; A47F 7/02; A47F 7/022; A47F 3/10; A47B 49/00; A47B 55/02
USPC ..... 211/85.2, 144, 163, 166; D6/680.2
See application file for complete search history.

(56) References Cited

U.S. PATENT DOCUMENTS

| | | | | | |
|---|---|---|---|---|---|
| 452,792 | A | * | 5/1891 | Jones | 211/120 |
| 858,159 | A | * | 6/1907 | Deis | 211/165 |
| 937,155 | A | * | 10/1909 | Krasne | 211/165 |
| 1,107,847 | A | * | 8/1914 | Saunders | 211/163 |
| 1,259,623 | A | * | 3/1918 | Herrick | 211/70 |
| 1,524,300 | A | * | 1/1925 | Gottlieb | 211/163 |
| 1,663,176 | A | * | 3/1928 | Reyher | 211/124 |
| 1,697,866 | A | * | 1/1929 | Hansen | 211/165 |
| D100,694 | S | * | 8/1936 | Hansen et al. | D6/457 |
| 2,071,290 | A | * | 2/1937 | Scriba | 211/58 |
| 2,155,097 | A | * | 4/1939 | Mendle | 248/125.1 |
| D137,374 | S | * | 2/1944 | Hansen et al. | D6/457 |
| 2,613,931 | A | * | 10/1952 | Singer | 472/7 |
| D168,095 | S | * | 11/1952 | Howard | D6/464 |
| D171,477 | S | * | 2/1954 | Anderson | D6/415 |
| 2,862,627 | A | * | 12/1958 | Mizanty | 211/163 |
| 3,195,736 | A | * | 7/1965 | Bomar, Jr. | 211/163 |
| D204,435 | S | * | 4/1966 | Hersh | D6/410 |
| 3,319,800 | A | * | 5/1967 | Bowles | 211/163 |
| 3,506,137 | A | * | 4/1970 | Smetanko et al. | 211/131.1 |
| 3,613,901 | A | * | 10/1971 | Montelius | 211/166 |
| 4,141,453 | A | * | 2/1979 | Hanan | 211/163 |
| 4,390,099 | A | * | 6/1983 | Trautlein et al. | 211/4 |
| 4,424,904 | A | * | 1/1984 | Applegate, Jr. | 211/40 |
| 4,534,471 | A | * | 8/1985 | Zahn et al. | 211/39 |
| 4,921,190 | A | * | 5/1990 | Russo et al. | 248/159 |
| 4,971,204 | A | * | 11/1990 | Alsobrook | 211/85.13 |

(Continued)

FOREIGN PATENT DOCUMENTS

| | | | |
|---|---|---|---|
| DE | 2206067 | A1 * | 8/1973 |
| DE | 9103943 | U1 * | 6/1991 |

(Continued)

*Primary Examiner* — Stanton L Krycinski
(74) *Attorney, Agent, or Firm* — Crossley Patent Law

(57) ABSTRACT

A jewelry stand including a base to support the stand on the surface of a table or a floor, a cylinder disposed in the center of the base and a plurality of rotating, adjustable tiers. Each tier has a plurality of single hook arms and alternately double hook arms configured in a spoke formation. Each single hook arm has a plurality of single hooks and each double hook arm has a plurality of double hooks disposed on each side, at a right angle to, and evenly spaced along each arm. Each single hook holds a single jewelry item, such as a necklace, bracelet or ring. Each double hook holds a pair of jewelry items, such as earrings. The tiers rotate about the cylinder and are adjustable to allow for organizing and displaying jewelry without tangling and to allow easy access to a jewelry item without removing another jewelry item.

3 Claims, 4 Drawing Sheets

(56) References Cited

U.S. PATENT DOCUMENTS

| | | | | | |
|---|---|---|---|---|---|
| 5,052,563 | A | * | 10/1991 | Camp | 211/85.2 |
| 5,054,624 | A | * | 10/1991 | Camp | 211/85.2 |
| D329,341 | S | * | 9/1992 | Rhodes | D6/457 |
| 5,168,985 | A | * | 12/1992 | Shih | 206/6.1 |
| D336,574 | S | * | 6/1993 | Rhodes | D6/469 |
| 5,423,435 | A | * | 6/1995 | Pollard et al. | 211/37 |
| 5,449,073 | A | | 9/1995 | DeBeverly | |
| D391,419 | S | * | 3/1998 | Walters et al. | D6/458 |
| 5,772,050 | A | * | 6/1998 | Shih | 211/39 |
| 5,839,586 | A | * | 11/1998 | Smith | 211/163 |
| 5,848,710 | A | | 12/1998 | Pomper | |
| 6,241,105 | B1 | * | 6/2001 | Pomper | 211/85.2 |
| D454,722 | S | * | 3/2002 | Novel | D6/415 |
| 6,568,546 | B1 | * | 5/2003 | Huang | 211/205 |
| 7,159,728 | B2 | * | 1/2007 | Smith | 211/166 |
| 7,451,882 | B2 | | 11/2008 | McKay | |
| D637,832 | S | * | 5/2011 | Russell | D6/405 |
| D665,197 | S | * | 8/2012 | Allameh | D6/472 |
| 2006/0065613 | A1 | * | 3/2006 | McKay | 211/85.2 |
| 2007/0057606 | A1 | * | 3/2007 | Christian | 312/245 |
| 2011/0089127 | A1 | * | 4/2011 | Thomas et al. | 211/163 |
| 2013/0168342 | A1 | * | 7/2013 | Yatscoff | 211/85.2 |

FOREIGN PATENT DOCUMENTS

| | | | | |
|---|---|---|---|---|
| DE | 29513242 | U1 | * | 10/1995 |
| DE | 202013102706 | U1 | * | 10/2013 |
| EP | 2449927 | A1 | * | 5/2012 |
| FR | 466604 | A | * | 5/1914 |

* cited by examiner

JEWELRY STAND

BACKGROUND OF THE INVENTION

Jewelry display stands are well known in the field and have been used not only for the retail jewelry industry, but in the home as well. The problem with conventional jewelry stands is that in order to access an item of jewelry, a user has to remove other items and the items become tangled. What is needed is a jewelry stand which has a number of rotating and tiers. Each tier has eight arms configured in a spoke formation. Each arm has a plurality of either double hooks or single hooks evenly spaced on both sides of the arms. The configuration of the present jewelry stand allows the user to display and organize jewelry items without the risk tangling while providing easy access to an item of jewelry without having to remove another item. The present invention also includes single hooks for organizing and displaying single jewelry items, such as a necklace, a bracelet and a ring, and double hooks for pairs of jewelry, such as pairs of earrings.

FIELD OF THE INVENTION

The present invention relates to organizers and displays for jewelry and similar articles. More particularly, the present invention relates to a rotatable stand for organizing and displaying jewelry which organizes jewelry to prevent tangling and allows a user easy access to an item or a pair of jewelry without having to remove another item of jewelry.

SUMMARY OF THE INVENTION

The general purpose of the present jewelry stand, described subsequently in greater detail, is to provide a jewelry stand which has many novel features that result in a jewelry stand which is not anticipated, rendered obvious, suggested, or even implied by prior art, either alone or in combination thereof.

To accomplish this, the present jewelry stand includes a base to support the jewelry stand on the surface of a table or the floor, a cylinder disposed in the center of the base and a plurality of rotating, adjustable tiers. Each tier has eight arms configured in a spoke formation. Each arm has a plurality of single hooks and alternately double hooks disposed on each side, at a right angle to, evenly spaced along each arm. The single hooks hold a single jewelry item such as a necklace, bracelet or ring. The double hooks hold a pair of jewelry items such as a pairs of earrings. The tiers rotate about the cylinder and are adjustable to allow for organizing and displaying the jewelry without tangling and to allow easy access to a jewelry item without having to remove another jewelry item.

Thus has been broadly outlined the more important features of the present jewelry stand so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
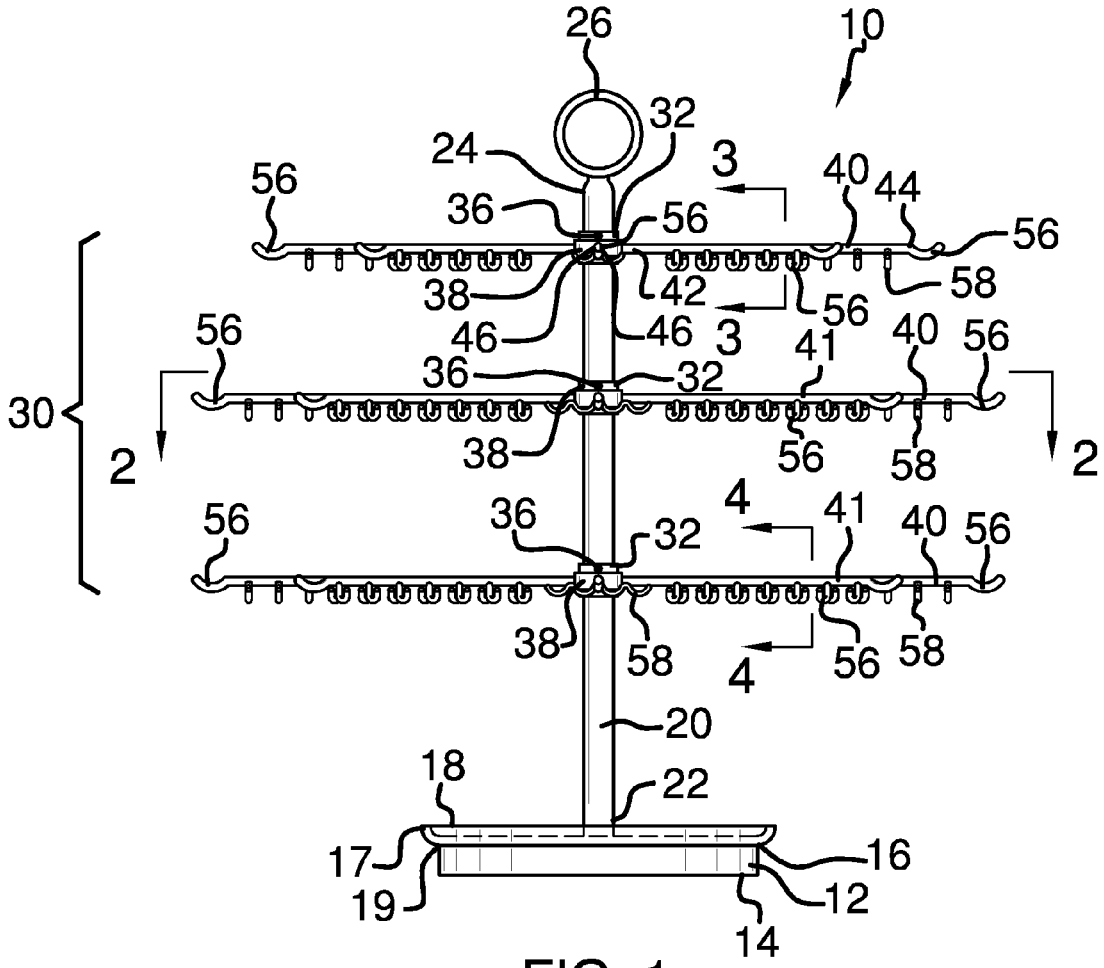
FIG. 1 is a front elevation view.
Figure 2:
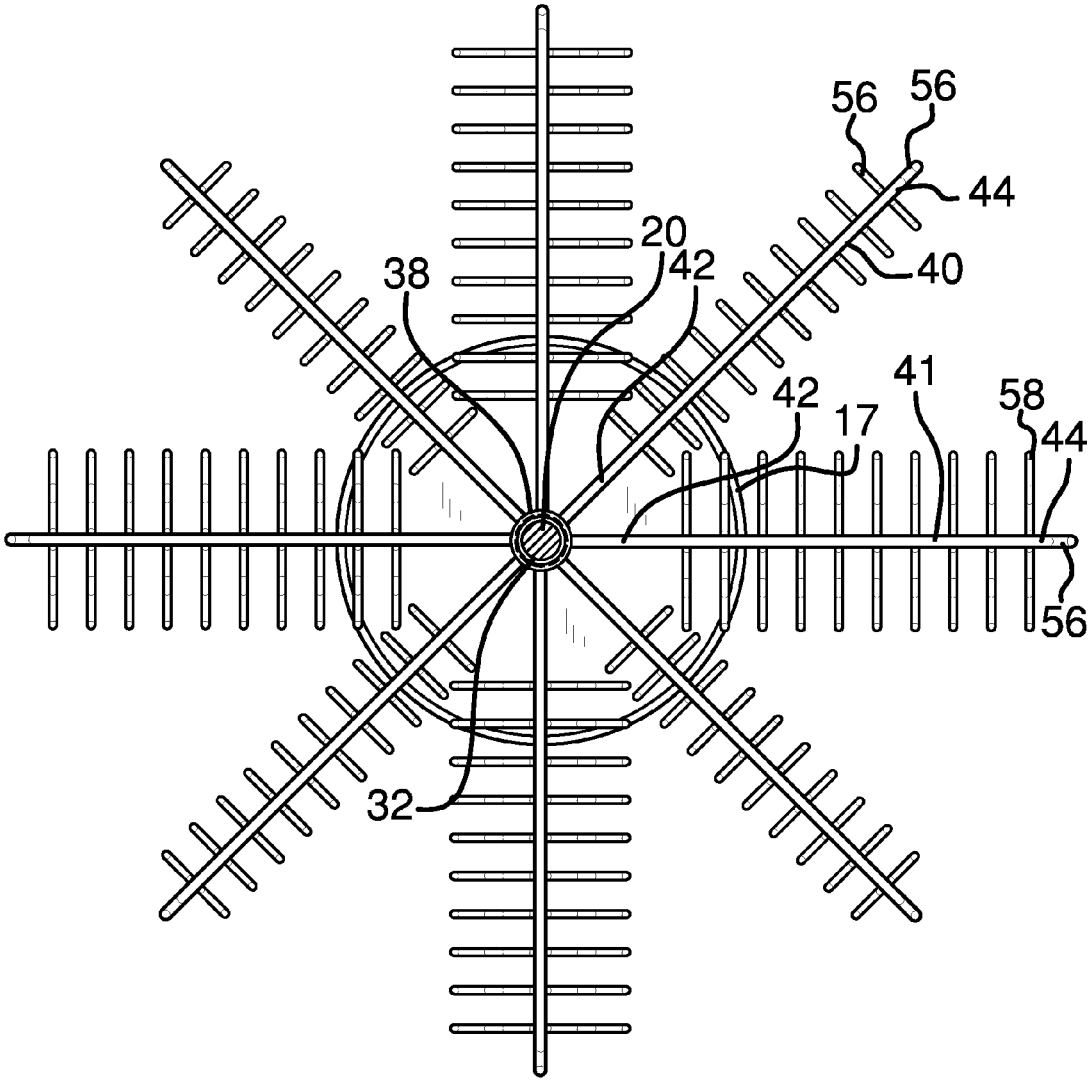
FIG. 2 is a cross-sectional view taken along line 2-2 of FIG. 1.
Figure 3:
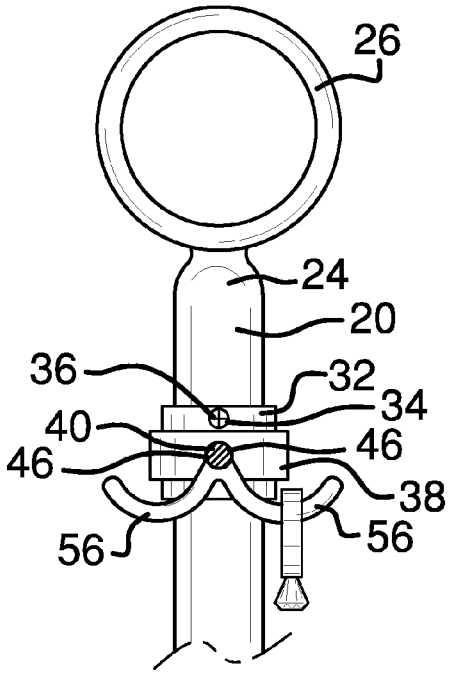
FIG. 3 is a cross sectional view taken along line 3-3 of FIG. 1.
Figure 4:
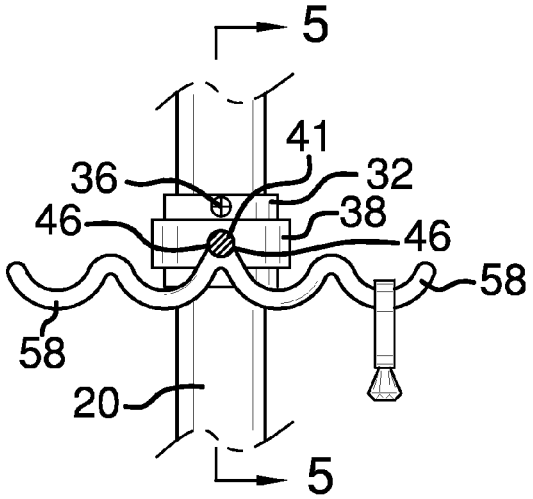
FIG. 4 is a cross-sectional view taken along line 4-4 of FIG. 1.

With reference now to the drawings, and in particular FIGS. 1 through 6 thereof, an example of the instant jewelry stand employing the principles and concepts of the present jewelry stand and generally designated by the reference number 10 will be described.

Referring to FIGS. 1 through 6 the present jewelry stand 10 is illustrated. The jewelry stand 10 includes a base 12 having a bottom side 14 and a top side 16. The base 12 is configured to support the jewelry stand 10 and the bottom side 12 is configured to sit on a surface of a table or other type of stand in a home or in retail operations. The base 12, as illustrated, is disk-shaped; however, other base shapes can be employed, such as a parallelepiped. A plate 17 having an upper side 18 and a lower side 19 is disposed on the top side 16 of the base 12. The plate 17 holds loose jewelry. A cylinder 20 having a bottom end 22 and a top end 24 is fixedly attached at the bottom end 22 atop the plate 18 in the center of the plate 12. An annular handle 26 is disposed on the top end 24 of the cylinder 20. A plurality of tiers 30 is disposed along the cylinder 20. Each tier 30 includes a bushing 32 with a plurality of set screw holes 34. The bushing 32 slidingly engages the cylinder 20. A plurality of set screws 36 engage the set screw holes 34 to lock the bushing 32 in place along the cylinder 20 and allow for adjustment of the distance between the tiers 30 along the cylinder 20. A ring 38 rotatingly engages the bushing 32. The ring 38 allows the tiers 30 to rotate around the bushing 32 on the cylinder 20. A plurality of single hook arms 40 and alternately double hook arms 41 is disposed on the ring 38. Each single hook arm 40 and each double hook arm 41 has a proximal end 42, a distal end 44, and two arm sides 46. The proximal end 42 is fixedly attached to the ring 38 in a spoke formation. Each single hook arm 40 includes a single hook 56 disposed on the distal end 44 and a plurality of single hooks 56 disposed on each arm side 46, at a right angle to and evenly spaced along the single hook arm 40. Each single hook 56 has a U-shape configured to hold a single item of jewelry, such as a necklace, a bracelet, or a ring. Each double hook arm 41 includes the single hook 56 disposed on the distal end 44 and a plurality of double hooks 58 disposed on each arm side 44, at a right angle to and evenly spaced along the double hook arm 52. Each double hook 58 has a double-U-shape configured to hold a pair of jewelry, such as a pair of earrings. The configuration of the rotating, adjustable tiers 30 as well as the evenly spaced hooks 56, 58 on each arm side 46 of each arm allow for organization and display of jewelry without tangling and to allow easy access to jewelry items without having to remove another jewelry item. The plurality of tiers 30 can comprise all single hook arms 40 in the spoke formation about the ring 32 and alternately single hook arms 40 alternating with double hook arms 41 in the spoke formation about the ring 32 (shown in FIG. 2).

Figure 5:
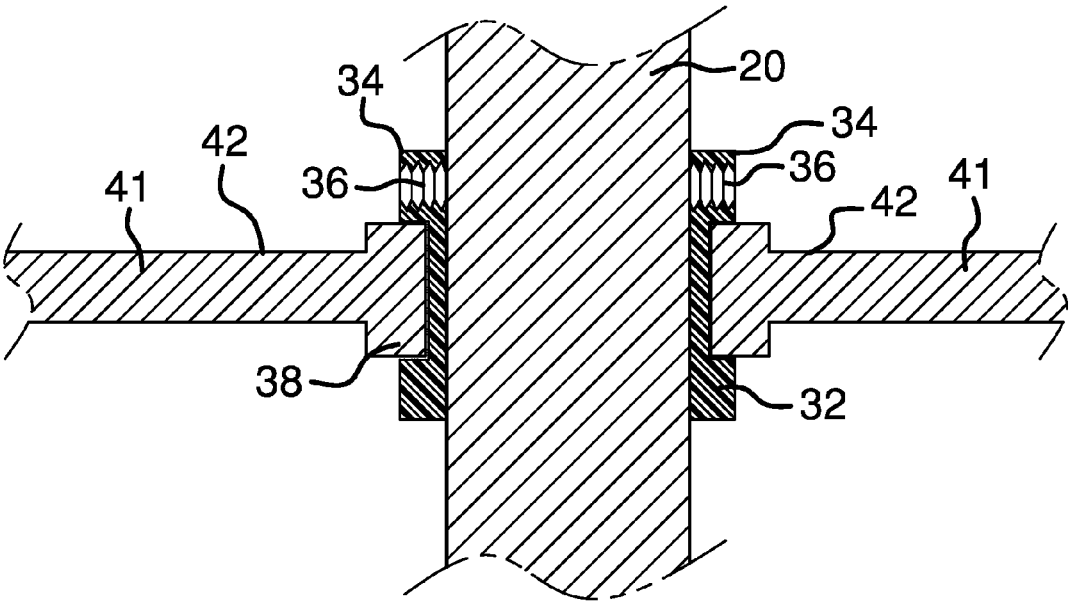
FIG. 5 is a cross-sectional view taken along line 5-5 of FIG. 4.
Figure 6:
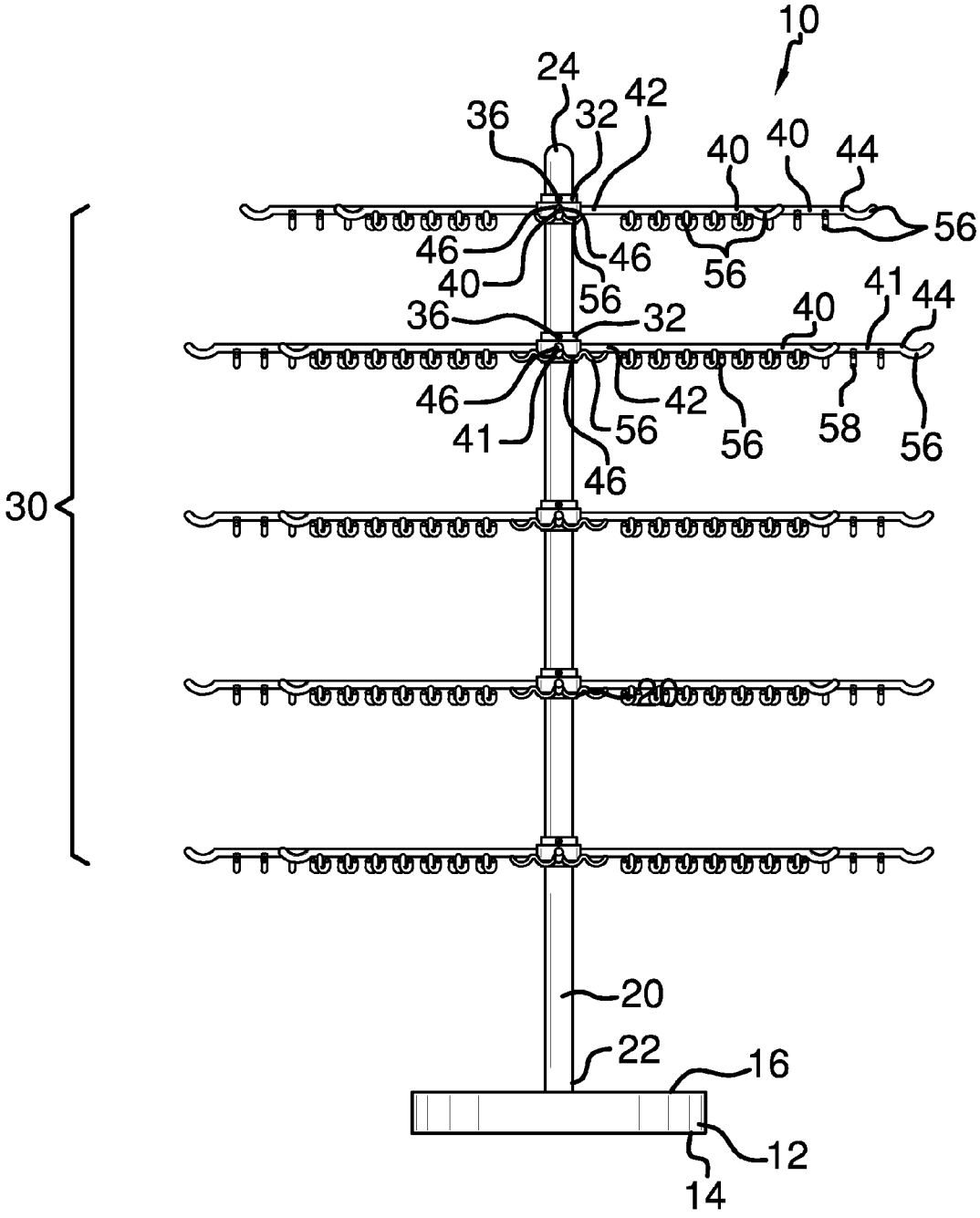
FIG. 6 is a front elevation view including additional single and double hook arms.

The jewelry stand 10 can also be produced for large retail applications, as shown in FIG. 5 which includes a base 12 that is configured to sit on a floor, without the plate 17 and the annular handle 26, a cylinder 20 of longer length, and additional tiers 30 to hold more jewelry. It should be appreciated that any number of tiers 30, any number of arms 40 with differing hook configurations may be used to configure the present jewelry stand 10.

What is claimed is:

1. A jewelry stand comprising:

a base having a top side and a bottom side;

a plate disposed on the top side of the base, the plate having an upper side and a lower side;

a cylinder having a bottom end and a top end, the bottom end being centrally disposed on the upper side of the plate;

an annular handle vertically disposed on the top end of the cylinder;

a plurality of tiers disposed perpendicularly with respect to the cylinder, each tier comprising:

a bushing, the bushing comprising a plurality of set screw holes, the bushing slidingly engaging the cylinder, the bushing being configured to vertically adjust along the cylinder;

a plurality of set screws, each set screw being configured to engage one of the set screw holes, the plurality of set screws being configured to lock the busing in place along the cylinder, a ring, the ring rotatingly engaging the bushing, the ring being configured to rotate about the bushing;

a plurality of arms, each arm having a proximal end, a distal end, and two arm sides; each proximal end being fixedly attached to the ring in a spoke formation; and a plurality of hooks fixedly attached to each arm side, wherein the plurality of hooks are evenly spaced along the arm;

wherein each tier rotates around the cylinder; and wherein the plurality of hooks comprise a plurality of single hooks and a plurality of double hooks, the single hooks having a U-shape configured to hold a single item of jewelry, the double hooks having two consecutive U-shape portions along a longitudinal length of the double hook configured to hold a pair of jewelry.

2. The jewelry stand of claim 1 wherein the plurality of arms includes a plurality of single hook arms and a plurality of double hook arms, wherein each single hook arm includes a single hook disposed on the distal end and a plurality of the single hooks disposed on each arm side, at a right angle to and evenly spaced along the single hook arm, wherein each double hook arm includes the single hook disposed on the distal end and a plurality of the double hooks disposed on each arm side, at a right angle to and evenly spaced along the double hook arm.

3. The jewelry stand of claim 2 wherein the plurality of tiers is selected from the group consisting of all of the single hook arms in the spoke formation about the ring and the single hook arms and the double hook arms alternating in the spoke formation about the ring.

* * * * *